US006800039B1

(12) United States Patent
Tseng

(10) Patent No.: US 6,800,039 B1
(45) Date of Patent: Oct. 5, 2004

(54) GOLF CLUB STRIKING FACE WITH VARIED THICKNESS DISTRIBUTION

(76) Inventor: Wen-Cheng Tseng, 12F-2, No. 275, Sec. 2, Ta-Hsing W. Rd., Taoyuan (TW)

( * ) Notice: Subject to any disclaimer, the term of this patent is extended or adjusted under 35 U.S.C. 154(b) by 0 days.

(21) Appl. No.: 10/384,723

(22) Filed: Mar. 11, 2003

(51) Int. Cl.[7] ..... A63B 53/04

(52) U.S. Cl. ..... 473/329; 473/342; 473/349; 473/345

(58) Field of Search ..... 473/329, 349, 473/350, 345, 346, 342, 290, 291

(56) References Cited

U.S. PATENT DOCUMENTS 2,087,685 A * 7/1937 Hackney ..... 473/349
3,814,437 A * 6/1974 Winquist ..... 473/350
D318,703 S * 7/1991 Shearer ..... D21/748
5,497,993 A * 3/1996 Shan ..... 473/329
5,669,824 A * 9/1997 Aizawa et al. ..... 473/291
5,695,411 A * 12/1997 Wright et al. ..... 473/332
5,954,596 A * 9/1999 Noble et al. ..... 473/346
5,971,868 A * 10/1999 Kosmatka ..... 473/349
6,007,432 A * 12/1999 Kosmatka ..... 473/324

* cited by examiner

*Primary Examiner*—Sebastiano Passaniti
(74) *Attorney, Agent, or Firm*—Alan D. Kamrath; Nikolai & Mersereau, P.A.

(57) ABSTRACT

A striking face of a golf club includes a rear face with varied thickness distribution. The rear face is divided into eight sections with an imaginary transverse line, a perpendicular line and two diagonal lines. The rear face has a joint position where the imaginary transverse line, perpendicular line and two diagonal lines join, and a joint where the rear face is adapted to engage with the golf club. The joint position has a maximum thickness, an inner peripheral edge of the joint engaging with the imaginary transverse line and the perpendicular line has a medium thickness and the inner peripheral edge of the joint engaging with the diagonal lines has a minimum thickness.

14 Claims, 7 Drawing Sheets

GOLF CLUB STRIKING FACE WITH VARIED THICKNESS DISTRIBUTION

BACKGROUND OF THE INVENTION

1. Field of the Invention

The present invention relates to a golf club striking face, and more particularly to a golf club striking face with varied thickness distribution so that when striking a golf ball with an area other than the sweet spot of the striking face, the golf ball is able to travel a distance the same as that by striking the golf ball with the sweet spot.

2. Description of Related Art

Numerous patents and products are introduced to the market to improve golf ball travelling distance. Some use a hollow golf club with an alloy encased in the hollow golf club, and some change the angle of the striking face. All these changes try to make the golf ball to have the maximum traveling distance. However, the maximum traveling distance of the golf ball only happens when the golfer strikes the golf ball with the sweet spot of the striking face. As well known in the art, golfers will have the their best performances only when striking the golf ball with the sweet spot. After striking the golf ball with the sweet spot, the golf ball will fly toward the designated direction.

However, due to the conditions of the golf course, the physical conditions of the golfers, etc., even a professional golfer can not guarantee that every strike is a perfect hit. Therefore, mis-hits of the golf ball happen many times during play on the golf course, especially to those who just begin to play golf.

To overcome the shortcomings, the present invention tends to provide an improved golf club striking face to mitigate and obviate the aforementioned problems.

SUMMARY OF THE INVENTION

The primary objective of the present invention is to provide an improved golf club striking face with varied thickness distribution so that when striking a golf ball with an area other than the sweet spot of the striking face, the golf ball can travel a distance the same as that of striking the golf ball with the sweet spot.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
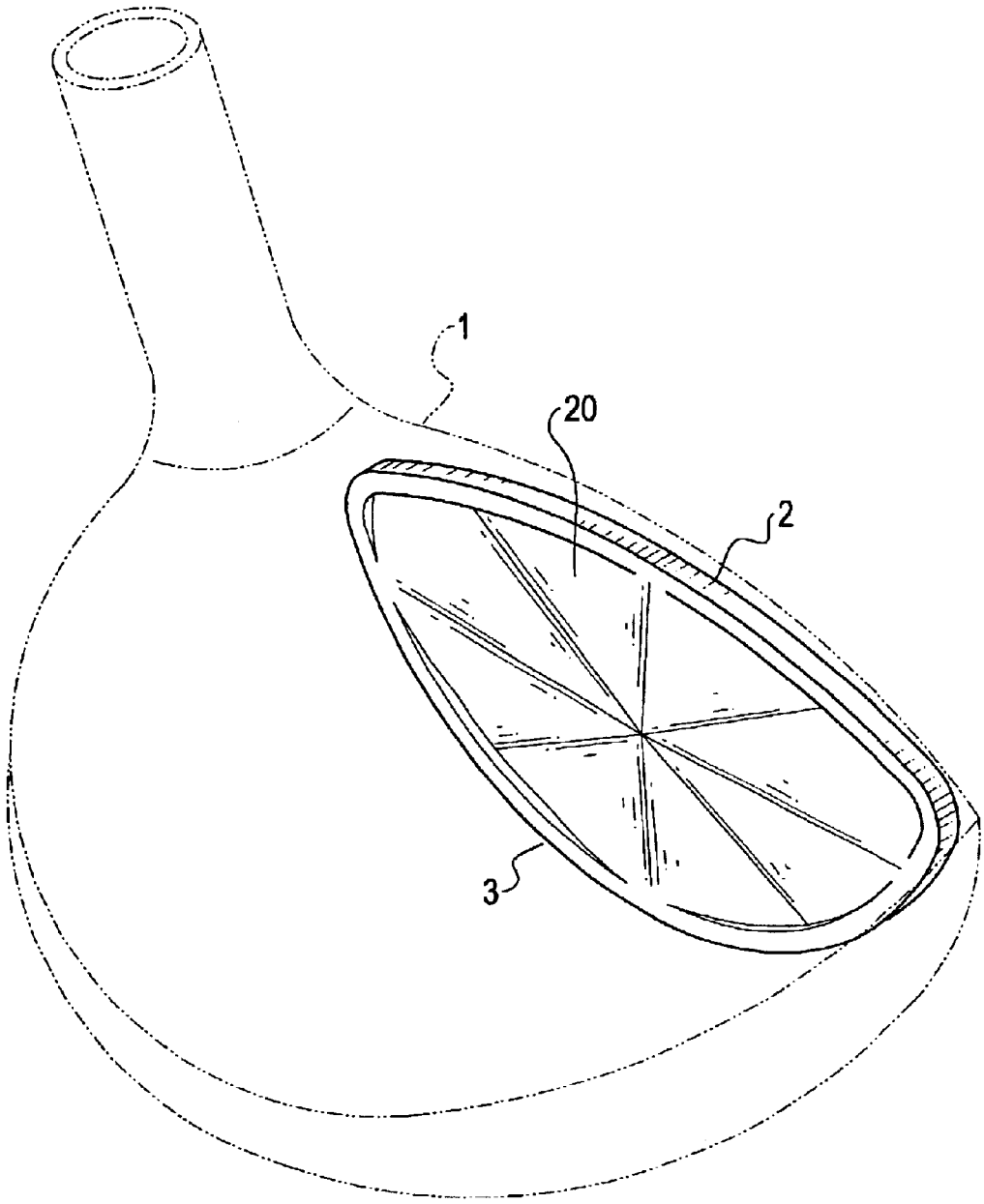
FIG. 1 is a perspective view of a rear side of the striking face of a golf club of the present invention.

With reference to FIG. 1, a golf club (1) has a striking face (2) engaging with the golf club (1) at a joint (3).

Figure 2:
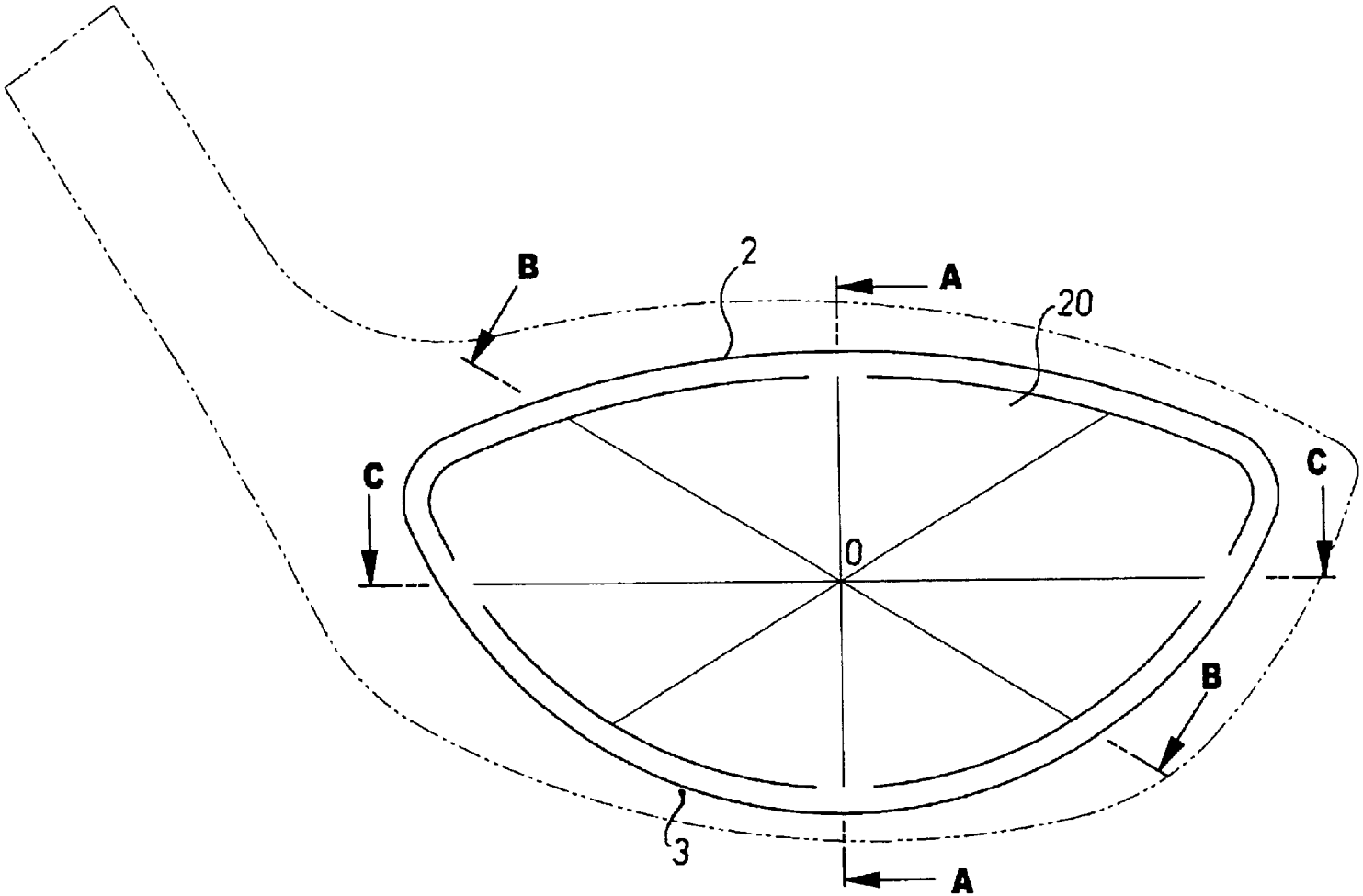
FIG. 2 is a plan view of the rear side of the striking face of the present invention.

With reference to FIG. 2, the striking face has a rear face (20). The rear face (20) is elliptical. A transverse line and a perpendicular line divide the elliptical rear face (20) into four sections with equal areas. Two diagonal lines respectively divide the four sections into eight sections with equal areas, wherein a center of the joint position (O) of the lines corresponds to the sweet spot.

Figure 3A:
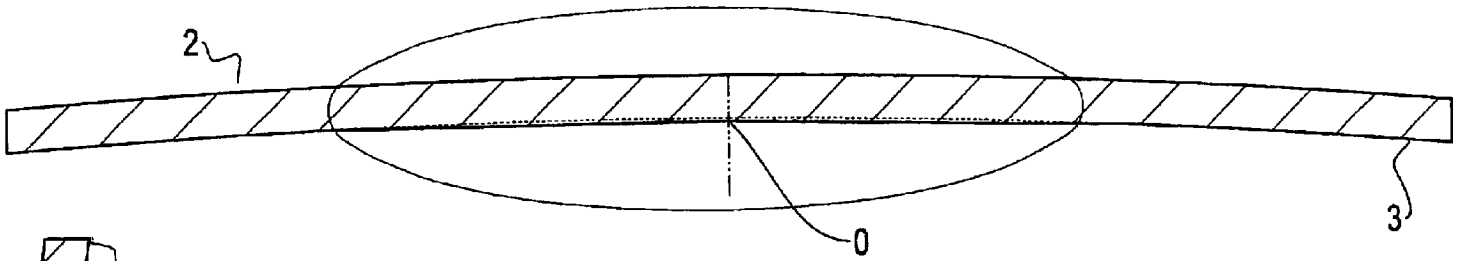
FIGS. 3A, 3B and 3C are cross sectional views of the striking face by taking lines A—A, B—B and C—C in FIG. 2.
Figure 3B:
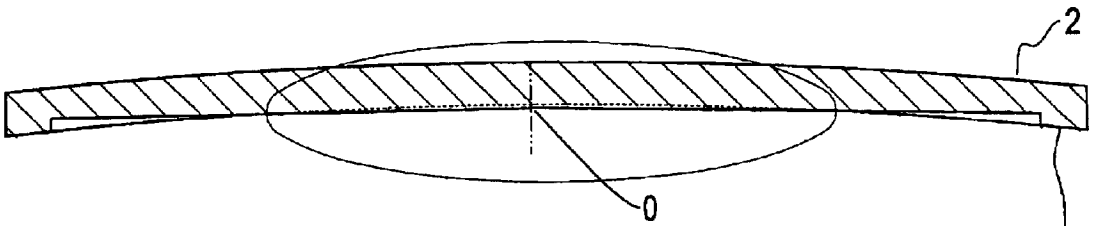
Figure 3C:
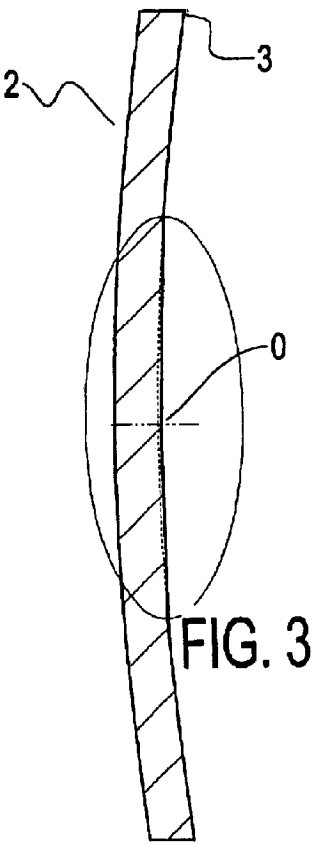
Figure 4:
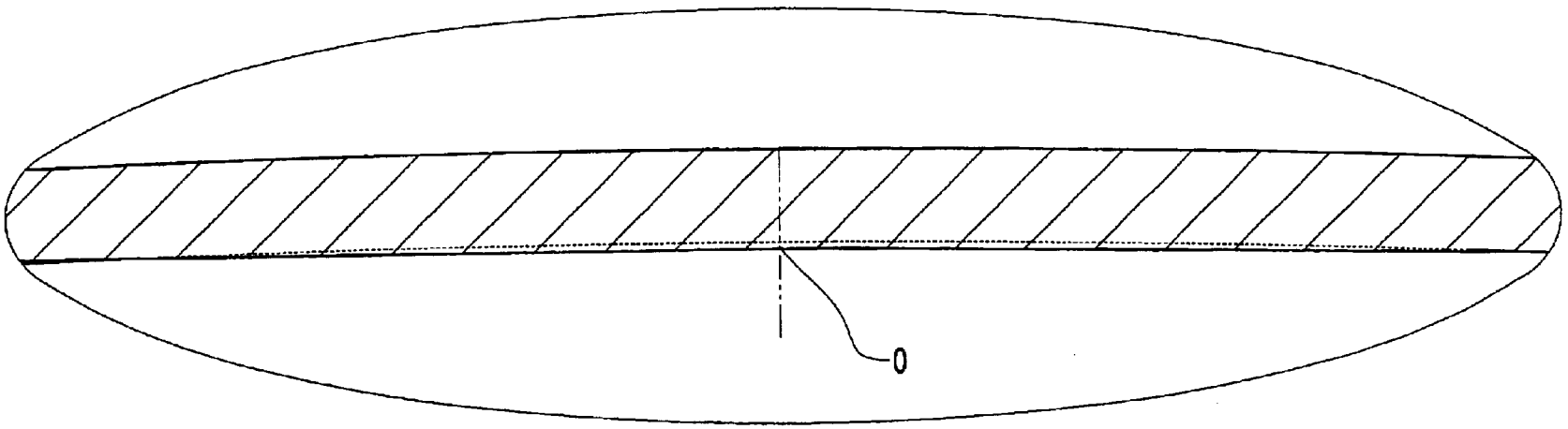
FIG. 4 is an enlarged cross sectional view of FIG. 3C.
Figure 7:
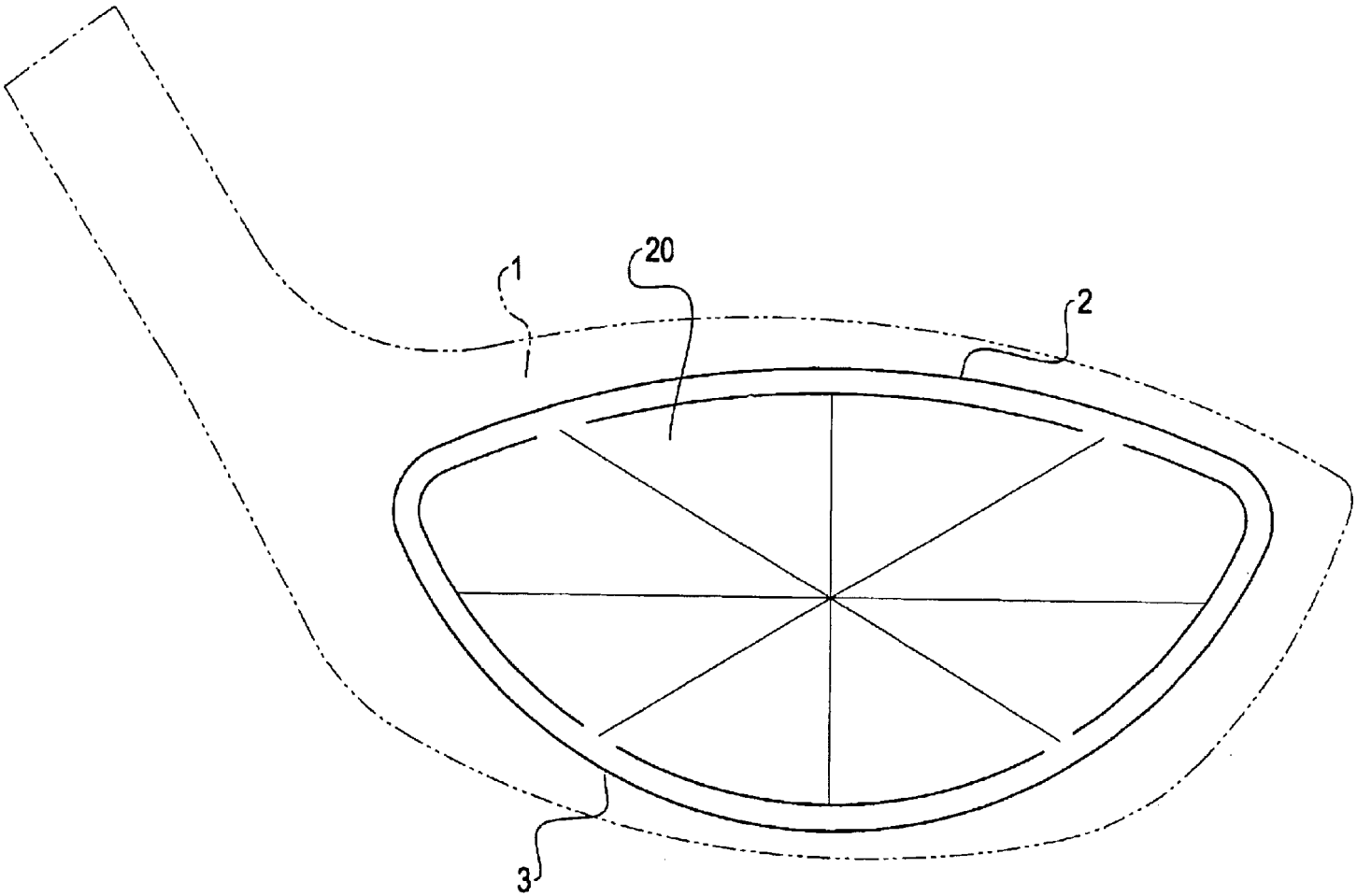
FIG. 7 is a plan view of the rear side of another embodiment of the striking face of the present invention.

With reference to FIGS. 3A, 3B and 3C and taking FIG. 4 for a better understanding of the structure of the rear face (20), it is noted that the rear face (20) of the striking face (2) has a maximum thickness, i.e. 3 mm. The joint (3) has a thickness i.e. 2.8 mm. An inner peripheral edge of the joint (3) engaging with the transverse line and the perpendicular line has a thickness the same as that of the joint (3). However the inner peripheral edge of the joint (3) engaging with the diagonal lines has a minimum thickness, i.e. 2 mm. Therefore, with reference to FIGS. 2 and 7, it is noted that the joint position (O) has the maximum thickness, the inner peripheral edge of the joint (3) engaging with the transverse line and the perpendicular line has a medium thickness and the inner peripheral edge of the joint (3) engaging with the diagonal lines has a minimum thickness, which is shown in the embodiment in FIG. 2. Another embodiment is that the joint position (O) has the maximum thickness, the inner peripheral edge of the joint (3) engaging with the diagonal lines has a medium thickness and the inner peripheral edge of the joint (3) engaging with the transverse line and the perpendicular line has a minimum thickness, which is shown in the embodiment in FIG. 7.

Figure 5:
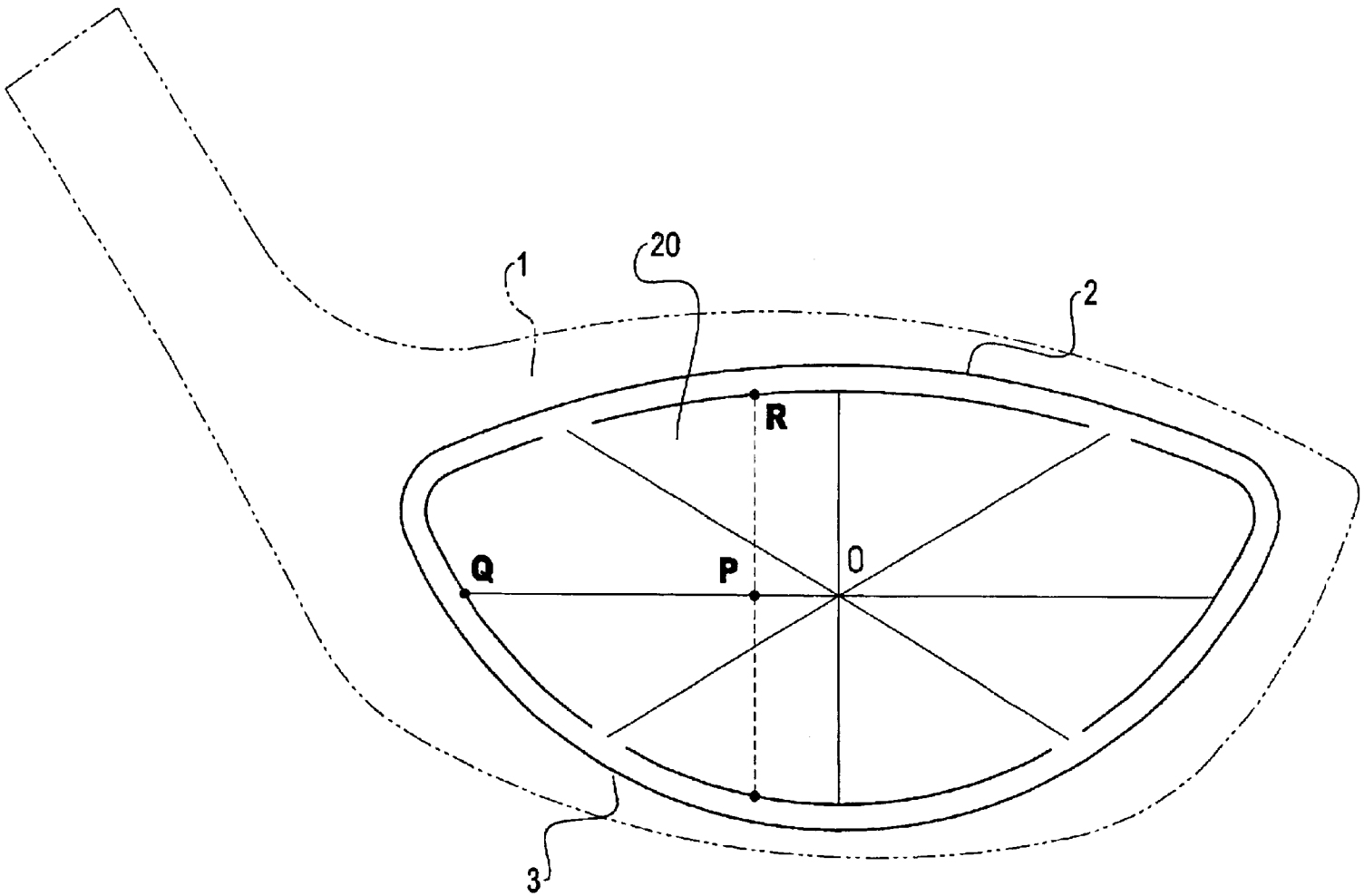
FIG. 5 is a schematic view of the striking face of the present invention.
Figure 6:
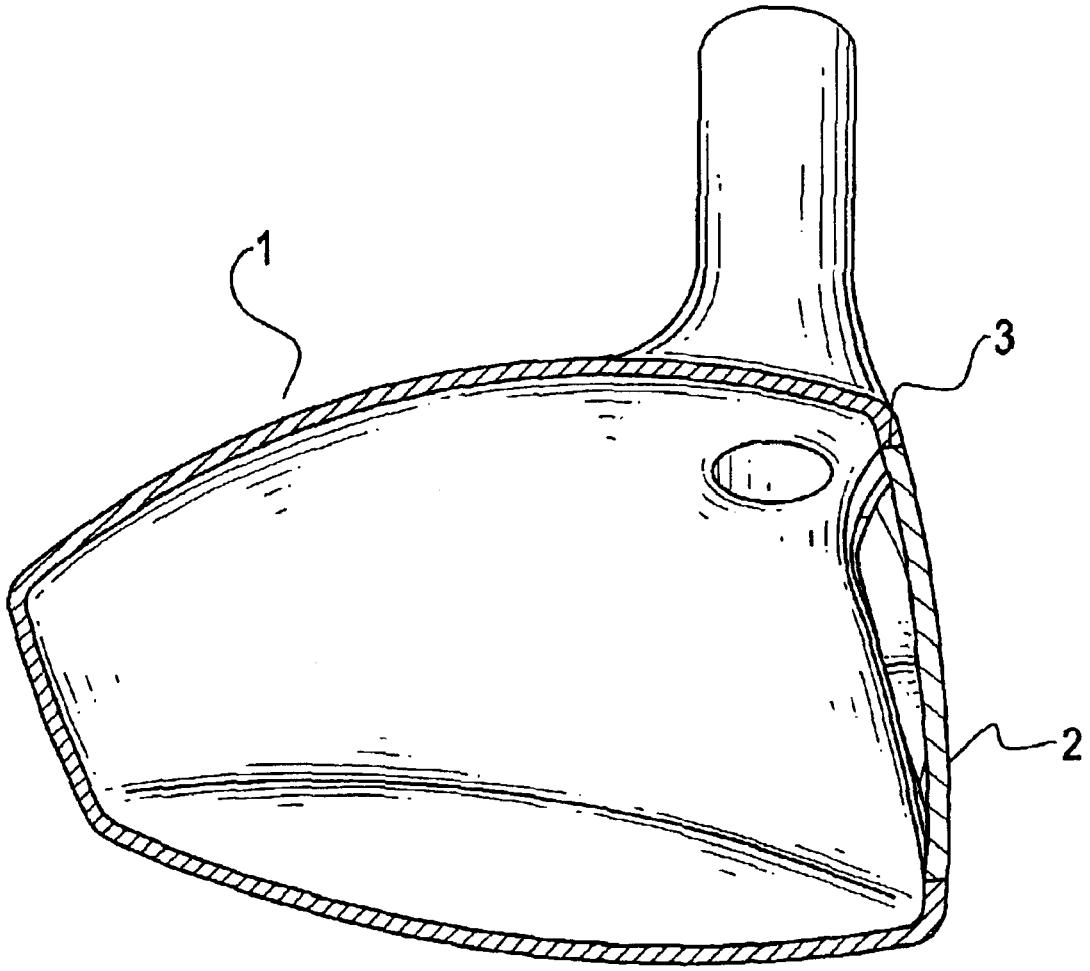
FIG. 6 is a side view of the golf club with the striking face of the present invention.

With reference to FIGS. 5 and 6, when a golfer is striking a golf ball at an area other than the joint position (O), if the area (striking position) is close to the joint position (O), the counter reaction to the golf ball will be the same as that of striking the golf ball with the joint position (O). When striking the golf ball at an area other than the joint position (O) and close to the joint (3), because the thickness is decreased, the counter reaction to the golf ball will be the same as that of striking the golf ball with the joint position (O). For example, when the golfer strikes the golf ball with point (P), the point (P) is close to joint position (O) but has a thickness less than that of the joint position (O) so that the counter reaction to the golf ball is the same as that of the joint position (O) to the golf ball. When comparing point (Q) and point (R), it is noted that the slope from the joint position (O) to the point (R) is more acute than that of the joint position (O) to the point (Q). Therefore, the effective striking area is within an area enclosed by a half distance from the joint position (O) to the joint (3).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A striking face of a golf club for striking a golf ball, the striking face having a front face and a rear face, with the front face, having an area of a size to strike the golf ball at differing striking positions, with the rear face having a varied thickness distribution providing a steady driving force to the golf ball wherever the striking position is on the front face, wherein the rear face includes a joint adapted to engage with the golf club, with the joint being annular and having an inner peripheral edge spaced from an outer peripheral edge, wherein the rear face is divided into eight sections with an imaginary transverse line, a perpendicular line and to diagonal lines, wherein the rear face has a joint position where the imaginary transverse line, perpendicular line and two diagonal lines join, wherein the joint position has a maximum thickness, the inner peripheral edge of the joint engaging with the imaginary transverse line and the perpendicular line has a medium thickness and the inner peripheral edge of the joint engaging with the diagonal lines has a minimum thickness, with the joint between the inner and outer peripheral edges having the medium thickness.

2. The striking face as claimed in claim 1, with the outer and inner peripheral edges being elliptical.

3. The striking face as claimed in claim 2, with the joint being separately formed from the golf club.

4. The striking face as claimed in claim 3, with the eight sections having equal areas.

5. The striking face as claimed in claim 1, with the joint being separately formed from the golf club.

6. The striking face as claimed in claim 5, with the eight sections having equal areas.

7. The striking face as claimed in claim 1, with the eight sections having equal areas.

8. A striking face of a golf club for striking a golf ball, the striking face having a front face and a rear face, with the front face having an area of a size to strike the golf ball at differing striking positions, with the rear face having a varied thickness distribution providing a steady driving force to the golf ball wherever the striking position is on the front face, wherein the rear face includes a joint adapted to engage with the golf club, with the joint being annular and having an inner peripheral edge spaced from an outer peripheral edge, wherein the rear face is divided into eight sections with an imaginary transverse line, a perpendicular line and two diagonal lines, wherein the rear face has a joint position where the imaginary transverse line, perpendicular line and two diagonal lines join, wherein the joint position has a maximum thickness, the inner peripheral edge of the joint engaging with the diagonal lines has a medium thickness and the inner peripheral edge of the joint engaging with the transverse line and the perpendicular line has a minimum thickness, with the joint between the inner and outer peripheral edges having the medium thickness.

9. The striking face as claimed in claim 8, with the outer and inner peripheral edges being elliptical.

10. The striking face as claimed in claim 9, with the joint being separately formed from the golf club.

11. The striking face as claimed in claim 10, with the eight sections having equal areas.

12. The striking face as claimed in claim 8, with the joint being separately formed from the golf club.

13. The striking face as claimed in claim 12, with the eight sections having equal areas.

14. The striking face as claimed in claim 8, with the eight sections having equal areas.

* * * * *